US008193487B2

(12) United States Patent
Briglin et al.

(10) Patent No.: US 8,193,487 B2
(45) Date of Patent: Jun. 5, 2012

(54) PORTABLE LIGHT EMITTING SAMPLING PROBE

(75) Inventors: Shawn Briglin, Chittenango, NY (US); Carl Gogol, Manlius, NY (US)

(73) Assignee: INFICON, Inc., East Syracuse, NY (US)

( * ) Notice: Subject to any disclaimer, the term of this patent is extended or adjusted under 35 U.S.C. 154(b) by 114 days.

(21) Appl. No.: 12/530,959

(22) PCT Filed: Mar. 17, 2008

(86) PCT No.: PCT/US2008/057207

§ 371 (c)(1),
(2), (4) Date: Dec. 1, 2009

(87) PCT Pub. No.: WO2008/115855

PCT Pub. Date: Sep. 25, 2008

(65) Prior Publication Data

US 2010/0072359 A1 Mar. 25, 2010

Related U.S. Application Data

(60) Provisional application No. 60/918,462, filed on Mar. 16, 2007.

(51) Int. Cl.
*H01J 49/00* (2006.01)

(52) U.S. Cl. ..... 250/288; 250/281; 250/282

(58) Field of Classification Search ..... None
See application file for complete search history.

(56) References Cited

U.S. PATENT DOCUMENTS

| | | | | |
|---|---|---|---|---|
| 4,433,982 | A | 2/1984 | Odernheimer et al. | |
| 5,252,060 | A * | 10/1993 | McKinnon et al. | 431/12 |
| 5,345,809 | A * | 9/1994 | Corrigan et al. | 73/23.2 |
| 5,401,298 | A | 3/1995 | Voss | |
| 5,426,300 | A | 6/1995 | Voss et al. | |
| 5,437,203 | A | 8/1995 | Koch et al. | |
| 6,541,765 | B1 * | 4/2003 | Vestal | 250/282 |
| 6,646,257 | B1 * | 11/2003 | Fischer et al. | 250/288 |
| 6,895,804 | B2 | 5/2005 | Lovell et al. | |
| 6,984,524 | B2 | 1/2006 | Nguyen et al. | |
| 7,078,681 | B2 * | 7/2006 | Fischer et al. | 250/288 |
| 7,091,483 | B2 * | 8/2006 | Fischer et al. | 250/288 |
| 7,241,989 | B2 * | 7/2007 | Miller et al. | 250/282 |
| 7,723,678 | B2 * | 5/2010 | Truche et al. | 250/288 |
| 2003/0193338 | A1 * | 10/2003 | Krasnobaev et al. | 324/464 |
| 2004/0079881 | A1 * | 4/2004 | Fischer et al. | 250/288 |
| 2005/0009172 | A1 * | 1/2005 | Yamakoshi et al. | 435/287.2 |

(Continued)

FOREIGN PATENT DOCUMENTS

EP 1394537 A1 * 3/2004

*Primary Examiner* — Jack Berman
*Assistant Examiner* — Andrew Smyth
(74) *Attorney, Agent, or Firm* — Hiscock & Barclay, LLP

(57) ABSTRACT

An apparatus for heating a surface to liberate at least one analyte for detection thereof includes a source of energy to irradiate the surface and a collector to collect at least one gas from the surface, the at least one gas being capable of including the a least one liberated analyte. The apparatus further includes a detector linked to the collector to detect the presence of the at least one liberated analyte wherein the detection is used to control the power of the energy source by utilizing feedback relating to at least one condition of the surface.

21 Claims, 7 Drawing Sheets

U.S. PATENT DOCUMENTS

2005/0037513 A1* 2/2005 Ivancic et al. ..... 436/171
2005/0195393 A1* 9/2005 Karanassios ..... 356/316
2005/0211911 A1* 9/2005 Fischer et al. ..... 250/423 R
2006/0138316 A1* 6/2006 Seydoux et al. ..... 250/282
2006/0151687 A1* 7/2006 Miller et al. ..... 250/282
2006/0243917 A1* 11/2006 Fischer et al. ..... 250/423 P
2007/0228271 A1* 10/2007 Truche et al. ..... 250/288
2008/0105036 A1* 5/2008 Kendler et al. ..... 73/31.05
2008/0169416 A1* 7/2008 Thompson et al. ..... 250/286

* cited by examiner

PORTABLE LIGHT EMITTING SAMPLING PROBE

CROSS REFERENCE TO RELATED APPLICATIONS

This application is based upon and claims priority under 35 USC §119 of PCT/US2008/057207, filed Mar. 17, 2008, which is based upon U.S. Ser. No. 60/918,462, entitled: PORTABLE LIGHT EMITTING SAMPLING PROBE, filed Mar. 16, 2007. The entire contents of each above noted application is herein incorporated by reference.

FIELD OF THE INVENTION

This application relates to the field of detection devices and more particularly to a portable light emitting device that is used to liberate low and moderate vapor pressure analytes from an irradiated surface in which the operation of the light source can be controlled upon feedback concerning at least one condition of the surface that is being irradiated.

BACKGROUND OF THE INVENTION

Chemical warfare agents (CWAs) present an obstacle to both the world's militaries and civilian populations. Of particular concern are those agents with both high human toxicity and long persistence. Persistence refers to the capacity of an agent to remain active and thus deny access to an area for an extended period of time. One example of such an agent is the nerve agent O-ethyl-S-(2-diisopropylaminoethyl) methylphosphonothiolate, frequently referred to as VX. Persistent chemical warfare agents, such as VX, may make an area unsafe for traversal for a considerable period of time following application of the agent. Consequently, there is exists a need in both the military and civilian populations to detect the presence of these agents in rural and urban terrains, and likewise, to demonstrate when a particular area is safe for soldiers, civilians and livestock to return safely.

The very same mechanism responsible for an agent's persistence, i.e., low vapor pressure, also makes these persistent agents difficult to detect with traditional vapor-based standoff detectors. Vapors only evolve at low rates unless the agent and the supporting matrix (soil, etc) are heated. Consequently, traditional detection mechanisms that offer high sensitivity have often required physical removal of a sample to an offsite laboratory for extraction and subsequent analysis. This manner of survey is undesirable for most military applications given that the time to collect a sample and transport the sample offsite is incompatible with the desired pace of operations. Other detection mechanisms designed to provide near real-time analysis often typically require some direct mechanical contact with the terrain. Some examples are surface wipes used with ion mobility spectrometers, chemical conversion schemes, and the membrane probe (U.S. Pat. No. 4,433,982) and contact wheel approach (U.S. Pat. No. 5,437,203) developed by Bruker. Direct contact is undesirable because components that touch the surface can become contaminated and therefore dangerous. The latter is of particular concern for any apparatus making contact with persistent agents, such as VX. The contacting surfaces can become so heavily contaminated that these surfaces are difficult or dangerous to clean and require disposal. Similarly, contamination with interferents may also mandate replacement or cleaning.

Like chemical warfare agents, unidentified energetic devices, including land mines, improvised explosive devices, and various unexploded ordinance, present a further obstacle to both the world's militaries and civilian populations.

In more privatized applications, such as law enforcement, there is a further need to understand the presence of various drug agents. In other instances, there is a need to identify the presence of certain toxic materials. One non-contact technique that has been utilized in the detection of such substances, as described herein, is through the use of ground penetrating radar, using a wideband antenna to irradiate the soil with an electromagnetic field covering a large frequency range. Reflections from the soil caused by dielectric variations are measured and are then converted into an image. This technique, however, has limitations. For example, the resolution required to image small objects requires GHz frequencies, which decrease soil penetration and increase image clutter. In addition, these systems are extremely expensive and inhibit widespread applications, such as for portable usage. Another non-contact technique, such as described in U.S. Pat. No. 6,895,804 to Lovell et al., involves the use of a strobe or laser that radiates high energy radiation in order to produce volatilization of the agents to be detected in extremely short bursts, ranging from 0.001 to 0.01 seconds in duration. These agents are then detected, using a mass spectrometer or other similar device.

In spite of the efficacy of the latter technique to detect materials of interest, there are subsidiary problems associated with its use. For example, the amount of energy required to sufficiently irradiate one particular surface—such as frozen soil—using the Lovell device could potentially cause burning of another surface, such as sod, causing damage to the collection/detection equipment, as well as to the surface. Lovell provides no mechanism to automatically compensate for the different power levels required by different surface conditions. It will be appreciated that in military or covert applications, burning or combustion of an irradiated surface can further lead to premature discovery of such detection events.

There is a need to develop a system that is capable of liberating a target analyte from soil and other diverse matrices, while simultaneously avoiding "overcooking" of the matrices. Overcooking in this sense liberates tars and other materials that are highly detrimental to virtually any type of downstream sensor.

SUMMARY OF THE INVENTION

According to one aspect, there is provided an apparatus for heating a surface in order to liberate at least one moderate or low vapor pressure analyte for detection thereof, said apparatus comprising a source of energy to irradiate said surface; a collector to collect at least one gas from said surface, said at least one gas being capable of including said at least one liberated analyte; a detector linked to said collector to detect the presence of said at least one liberated analyte; and means for controlling the power of said energy source, said power controlling means including feedback means for detecting at least one condition of said surface.

The feedback means is provided in the detector according to one version, wherein the detector is programmed to detect at least one signature gas acting as a surface condition indicator.

The energy source utilizes light energy, such as infrared light and according to one version, the detector including a mass spectrometer. The feedback means according to one aspect comprises a temperature measuring device that is disposed in proximity to the surface that is irradiated, the temperature measuring device being linked to a controller of the light emitting energy source.

According to one version, the output of the temperature measuring device is used to determine when the power of the light emitting energy source should be reduced, i.e., when a predetermined temperature has been reached or exceeded as detected by the temperature measuring device.

A headspace is disposed in relation to the collector and the surface, into which a portion of the collector extends. The light source is retained within a probe head that includes a distal end, the distal end including a peripheral skirt or other sealing means that defines the headspace. The temperature measuring device and the collector each extend into the headspace, preferably through openings in a window provided at the distal end of the probe head.

According to another one version, the feedback means is configured through the detector to detect at least one of $H_2O$ and $CO_2$ as surface indicators. In another version, the detection of the above or other signature agents is used in order to determine that combustion is taking place due to irradiation or that the surface has reached a specific temperature.

The window is preferably made from a light transmissive material, or a material that permits heating energy from the emitters to pass therethrough. Alternatively, the distal end of the probe head can comprise a grid structure having a substantially open area.

According to another aspect, there is provided a protecting apparatus used to detect the presence of at least one moderate or low vapor pressure analyte liberated from a surface, said method comprising the steps of: irradiating said surface with a source of energy to heat said surface and to liberate said at least one analyte, if said at least one analyte is present; collecting gas containing said at least one analyte caused by irradiating said surface; detecting the presence of said at least one analyte using a detector linked to said collector; and controlling the operation of said energy source by determining a condition of said surface and adjusting the power of said energy source based on the determined condition.

The herein described method can include the additional step of measuring the temperature of the air volume adjacent to the surface as an indicator of the surface temperature during the irradiation step and reducing the power of the energy source if a predetermined temperature is exceeded.

The herein described method can also include the additional step of detecting at least one collected signature gas indicative of a surface condition and reducing the power of the energy source if the at least one, signature gas is detected.

The signature gas can be, for example, at least one of $H_2O$ and $CO_2$, or any other signature gas, including certain hydrocarbons that are liberated from heated plant materials, that is indicative of a temperature increase in the irradiated surface or at least one being indicative of combustion of the surface, indicative of a surface condition that is capable of contaminating the collector, or indicative that the surface has been sufficiently heated in order to liberate at least one analyte.

An advantage provided is that feedback provides a suitable indication that surface irradiation and/or that volitalization of compounds for detection is occurring. As a result, more efficient and timely use is made with the detection apparatus.

The herein-described assembly can be used portably by a single individual to detect surface-localized chemical warfare agents, explosive-related compounds, drug agents, light pesticides and/or herbicides and other semivolatiles of interest wherein the sample collection part of the system at worse case, makes very limited contact with the terrain, thereby mitigating contamination issues.

Another advantage is that this feedback control improves the useful life of the probe, as well as other components of the detector apparatus.

Yet another advantage is that the feedback control provided by the herein described probe assembly permits the detection of certain volatile chemical compounds from frozen surfaces wherein combustion of the surface and volatilization of the compounds can be safely monitored.

Yet still another advantage realized is that through feedback control; only the minimal required power is required for irradiation, thereby reducing power (battery) consumption.

These and other features and advantages will be readily apparent from the following Detailed Description which should be read in conjunction with the accompanying drawings.

DETAILED DESCRIPTION

The following relates to a portable light energy emitting sampling probe assembly that is used to desorb materials having a high boiling point or materials having a low or moderate vapor pressure from various surfaces, such as, for example, a grassy soil covered surface, a floor, or pavement. Moreover, "surfaces" as intended herein can refer to any matrix or object that can be examined. Throughout the course of discussion several terms, such as "upper", "lower", "above", "below" "proximal", "distal", "internal", "external", and the like have been used in order to provide a suitable frame of reference with regard to the accompanying drawings. These terms are not intended to be limiting, however, except where so specifically indicated.

Figure 1:
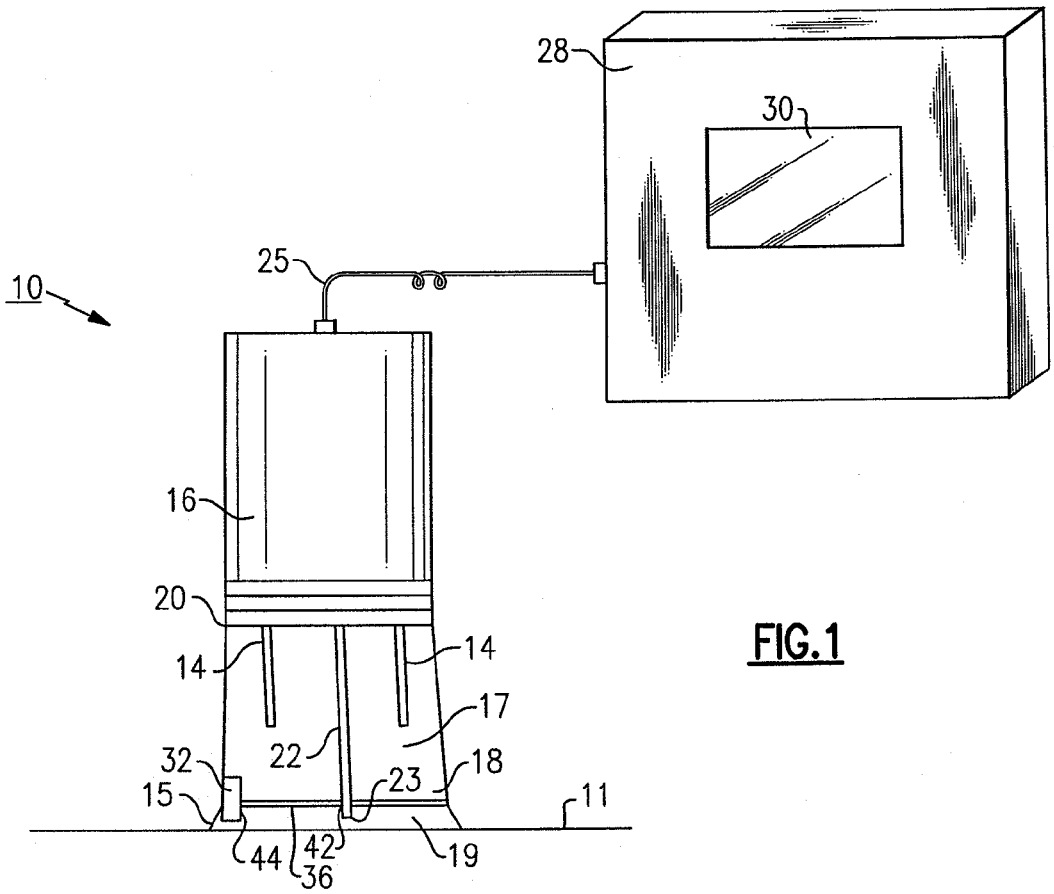
FIG. 1 is a perspective view of a portable light energy sampling probe that is made in accordance with a first embodiment.

Referring to FIG. 1, there is shown an exemplary portable light energy emitting sampling probe assembly, generally labeled by reference numeral 10. The portable light energy emitting sampling probe assembly 10, according to this embodiment, is defined by a housing 16 having a sampling probe enclosure (herein also referred to as a probe head 17), the latter including an open lower or distal end 18. A series of light energy emitters 14, such as IR (infrared) emitters, are positioned within the interior of the probe head 17 and more particularly are mounted within an upper portion thereof. In this exemplary embodiment, three (3) IR emitters are utilized; however, this number can be varied based on output and power consumption characteristics, among other factors: A heated collector tube or conduit 22 includes a sampling end 23 that extends from the distal end 18 of the probe head 17.

The remainder of the collector tube 22 extends through the proximal end 20 of the probe head 17 to the interior thereof via a capillary 25 or other means further extending to a detector 28. The detector 28 used in this particular embodiment is a portable HAPSITE gas chromatograph/mass spectrometer (GC/MS) manufactured by Inficon, Inc. It will be readily apparent from the following discussion that other suitable detectors, such as those manufactured by Bruker, General Electric Company, Smith's Detection and others could also be employed for purposes of the present invention.

The collector tube 22/capillary 25 is attached to a sample pump (not shown) of the detector 28 that is used to draw sample compounds through the sampling end 23 of the heated collector tube 22 using air as the carrier gas, from an irradiated surface to the detector 28. As previously noted and for purposes of this discussion, a "surface" is intended to be broadly interpreted so as to cover objects handled by a user, such as a rock or a soil sample.

For purposes of completeness, the detector 28 used in this exemplary embodiment includes a sample loop or concentrator tube, which traps analyte from the air carrier drawn by the sample pump. During the period of time when the sample loop or concentrator is being loaded, the air carrier gas is also analyzed directly by the mass spectrometer for signature species ($CO_2$, water). After concentrating for a desired period, or as determined by the surface condition, components trapped in the sample loop or in the concentrator tube are injected into a gas chromatograph column with nitrogen carrier gas for separation before delivery to the mass spectrometer. As each compound emerges from the gas chromatograph column, it passes through a membrane interface into the mass spectrometer where the sample is fragmented by high-energy electron impact ionization. The mass fragments are then filtered with a quadruple mass filter before detection, as with an electron multiplier. The detector 28 includes a display 30, FIG. 1, wherein the ion spectra can be shown, the detector having a microprocessor and a user interface (not shown) that enables sampling control. Compound identifications are achieved by matching ion spectra in a stored NIST (National Institute for Standards and Technology) library. Details relating to the overall operation of a mass spectrometer, such as those used herein, can be found in U.S. Pat. Nos. 5,426,300 and 5,401,298, the entire contents of each of these references being incorporated herein by reference.

Referring back to FIG. 1, at least one temperature measuring sensor 32, such as a thermistor or thermocouple, is also mounted and provided at the distal end 18 of the probe head 17. For example, the temperature measuring sensor 32 is connected by conventional means to an interior side wall thereof. According to this exemplary embodiment, a window 36 is used to cover the open distal end or port 18 of the probe enclosure 17. The window 36 is fabricated, according to this embodiment, from a light transmissive material, and preferably from a highly infrared transparent material, such as silicon, quartz, or sapphire, or other suitable material that permits at least the heating energy portion of light generated by the emitters 14 to pass therethrough. Alternatively, the window 36 can he replaced by a mesh or grid structure (not shown) having a substantially open area. The window 36 includes a pair of ports or openings 42, 44, each of which is sized to receive the sampling end 23 of the collector tube 22 and the temperature measuring sensor 32, respectively, in substantial close fitting engagement, thereby protecting the interior of the probe head 17. The distal end 18 of the probe head 17 also preferably includes a peripheral skirt 15, made from a highly flexible material, such as silicone foam rubber, which is placed in contact with the surface, matrix, or terrain 11 to be irradiated, thereby forming a substantially sealed headspace 19 to facilitate analyte vapor transport while mitigating carryover of target analyte or interferents. The peripheral skirt acts a wind-blocking dam in this sense. Alternatively, other techniques for creating an effective blocking apparatus, such as, for example, making the entire probe head from a highly flexible material, can be used.

The temperature measuring sensor 32 is used to monitor the temperature within the defined headspace 19 of an irradiated terrain or surface 11 and to provide feedback to the assembly 10. Such feedback can, for example, verify wither the light energy emitters 14 are actually irradiating the surface 11 of interest and also determine when the temperature of an irradiated surface has reached a value sufficiently indicative that volatilization of surface agents should have occurred.

Figure 2:
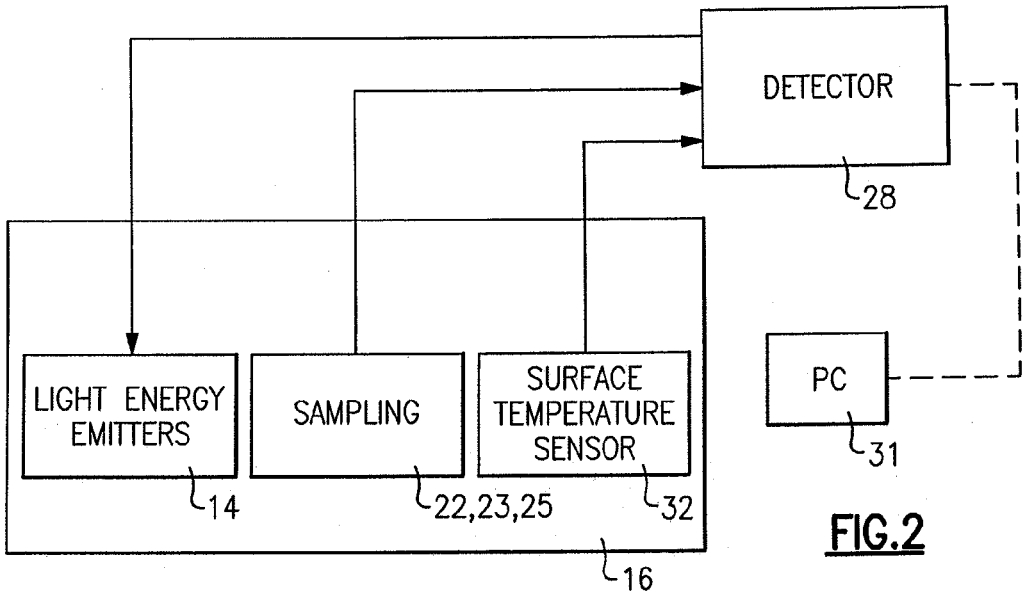
FIG. 2 is a functional block diagram of the portable sampling probe depicted in FIG. 1.

Referring to FIG. 2, a functional block diagram is provided of the herein described portable light emitting sampling probe assembly 10. According to this embodiment, the output of the temperature measuring sensor 32 is input in real time to the detector 28, wherein the detector is operatively connected to the light energy emitters 14 to control the emissions thereof.

A control function is programmed within the resident software of the detector 28 according to this embodiment, or a separate discrete controller unit, (not shown) can be provided to interconnect the temperature measuring sensor 32, the emitters 14, and the detector 28. A separate PC 31 can also be included and connected to the detector 28, if needed. To that end, the detector 28 can be configured or "tuned" in order to detect specified signature gases, including combustion agents, such as $CO_2$ for example, or hydrocarbons indicative of organic molecules liberated from heated plant materials (some of these hydrocarbons are responsible for fouling the device and detector, if overheated) or as $H_2O$ indicative of the heating of water containing vegetation near or above the boiling point of water. Alternatively, the detector can be repeatedly scanned through the entire mass scale, such as to track all of the species of interest nearly simultaneously. Detection of combustion gases provides an indication that combustion is occurring or has occurred within the defined headspace 19, FIG. 1. These feedback mechanisms can be used by the sampling probe assembly 10, as described by the following examples, with reference to FIGS. 3-5.

Figure 3:
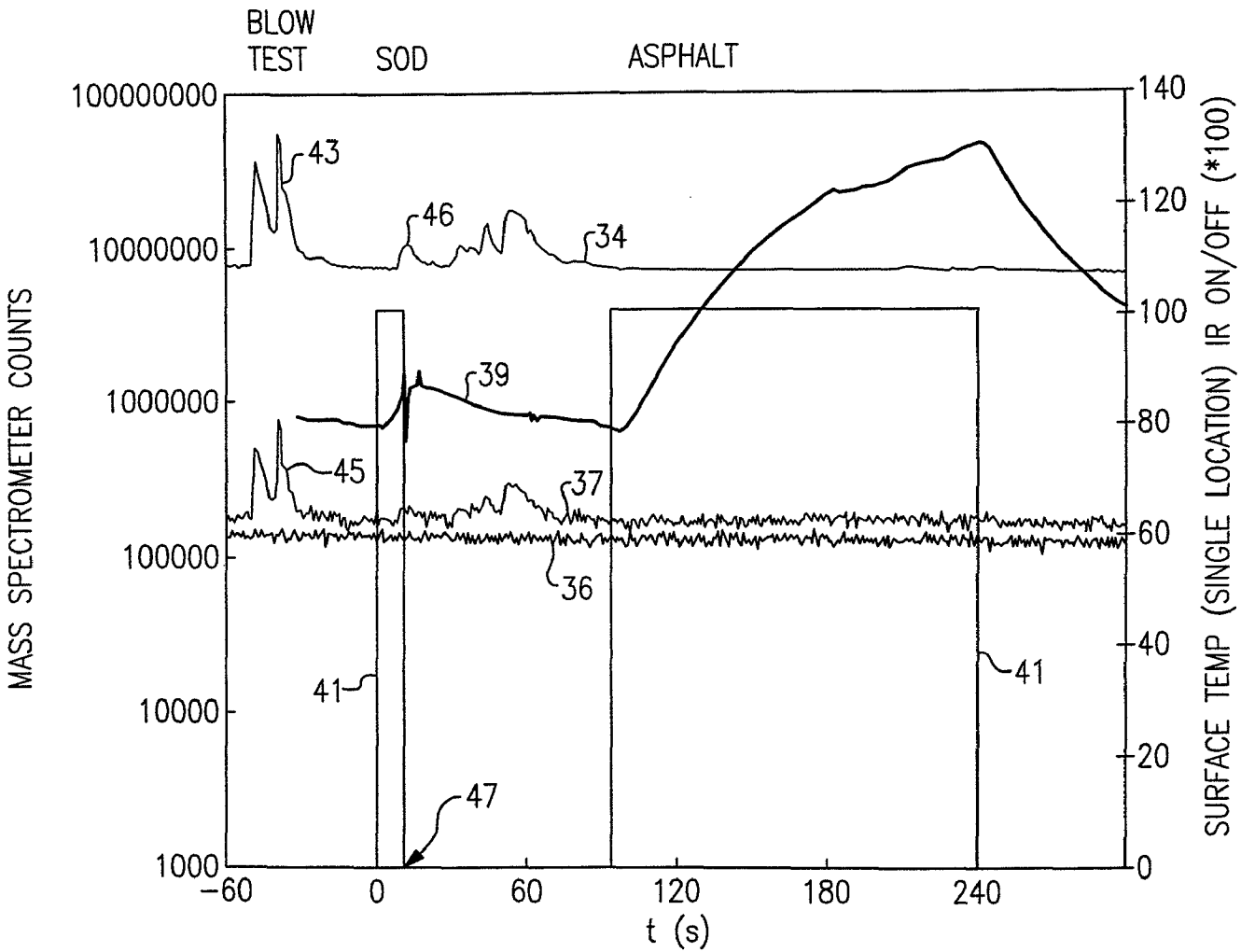
FIG. 3 illustrates a sample display output obtained from the sampling probe of FIGS. 1 and 2 including use of various feedback means used with the apparatus on different surfaces.

Referring first to FIG. 3, a display output for the herein described sampling probe assembly 10 is provided. This display can be provided by the detector 28 itself using display 30 or by means of the attached PC 31, FIG. 2. Ion counts, as measured by the detector 28 (mass spectrometer) are measured against time (in seconds), as well as the temperature of headspace volume 19, as measured by the temperature measuring sensor 32 in degrees Celsius. More particularly, measurements are taken herein for three (3) different surface types/conditions. For purposes of the output, the mass spectrometer measures $CO_2$ at a molecular weight of approximately 44 amu and certain hydrocarbons indicative of organic molecules liberated from heated plant materials, these hydrocarbons often having a characteristic molecular weight fragment of 57 amu. Representative plots of the $CO_2$ and hydrocarbon output are depicted as 34 and 36, respectively. An additional plot of $CO_2$ having carbon—13 is shown as 37. In addition, surface temperature is plotted, as shown by curve 39, as well as the on/off time of the light energy emitters 14, indicated as curve 41.

In the first surface condition, a breath of air is blown against the distal end of the probe head 17, FIG. 1, wherein the mass spectrometer indicates the presence of $CO_2$ shown by spikes 43, 45 in plots 34 and 37, respectively. The detected presence of $CO_2$ as shown validates the system. For purposes of the remaining examples of FIGS. 3-5, the detector 28, FIG. 1, is configured to nominally drive the light energy emitters for a period of 150 seconds at a constant power level of 30 Watts. The feedback mechanisms described herein affect the application of nominal power to the emitters 14, as follows:

In the second surface condition, a sod sample is irradiated for approximately 15 seconds, wherein the resulting temperature of head space volume 19 during irradiation is shown by curve 39. A resulting spike 46 in the level of $CO_2$ provides feedback to the detector 28, FIG. 1, that combustion of the sod surface has occurred. This feedback is immediately and automatically communicated to the emitter control, cutting the power to the emitters 14, as shown by reference arrow 47, and prematurely terminating the emitter pulse.

Finally in the third depicted surface condition, asphalt concrete (hereafter referred to as asphalt) is utilized wherein a full power pulse of light energy is provided by the emitters 14, FIG. 1, to the surface for 150 seconds. In this instance, no change in either monitored signature gas ($CO_2$ or hydrocarbons) is detected by the detector 28 during the irradiation time period and as a result, it is deduced that no surface combustion or overheating of plant materials has occurred. The resulting temperature curve 39, however, indicates that the light energy emitters 14 are working properly in heating the surface, as measured by the temperature measuring sensor 32 over this time period, as temperature rises for the entire duration of the pulse curve 41.

Figure 4:
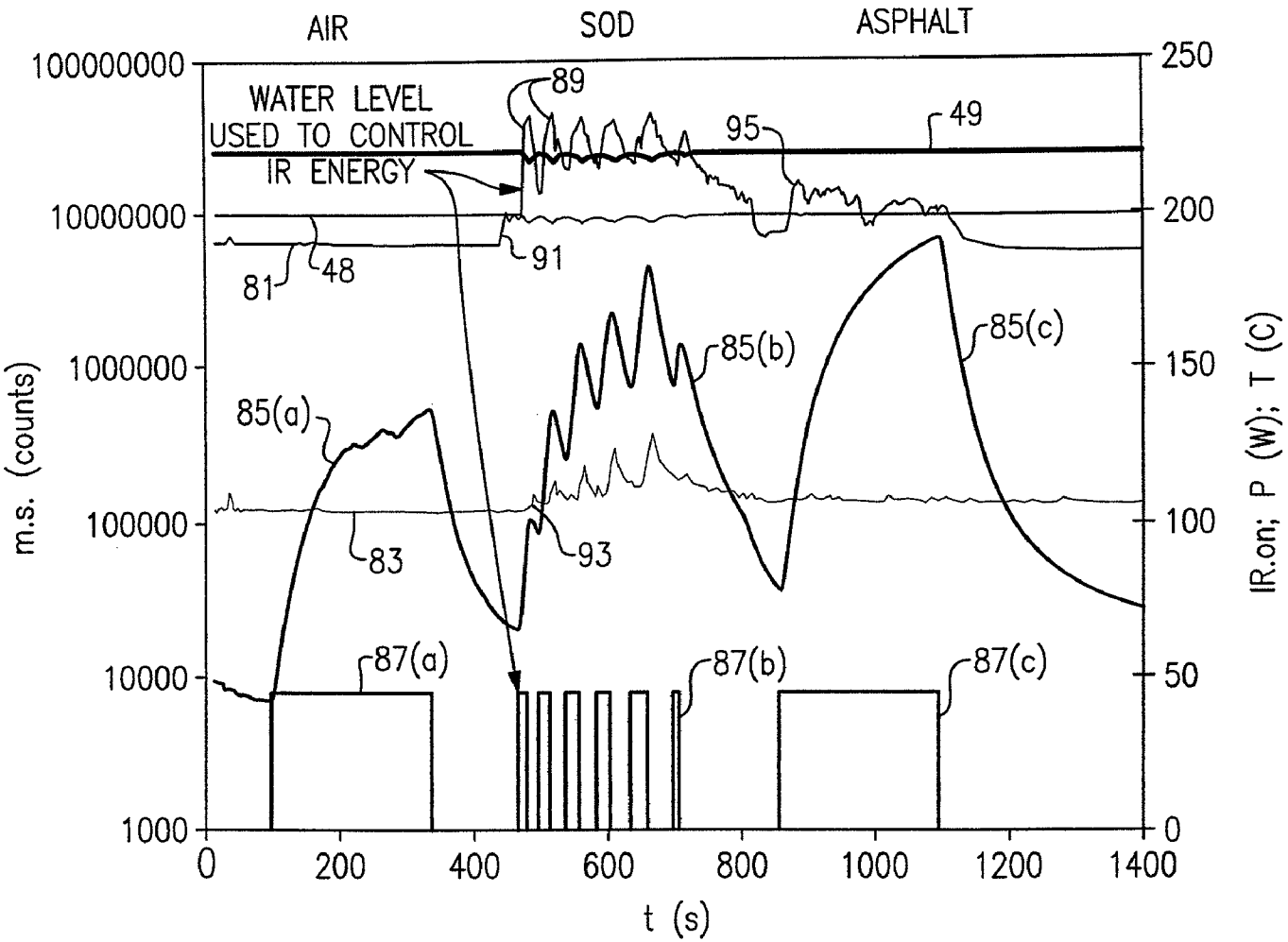
FIG. 4 is a second sample display of output from the sampling probe of FIGS. 1 and 2 that is representative of various surfaces irradiated by the sampling probe.

Referring to FIG. 4, there is depicted another sample output of the herein described sampling probe assembly 10, FIG. 1. In this example, mass spectrometer ion counts used to detect various ion (mass) spectra are again measured as a function of time (measured in seconds), as well as the temperature in the headspace volume 19 adjacent to three different surfaces. In this instance, the surfaces irradiated are that of air, sod and asphalt, similar to that of the preceding example. In this instance, the detector 28 (mass spectrometer) is used to monitor the presence of the following spectra; namely, water ($H_2O$—18 amu), nitrogen ($N_2$—28 amu), oxygen ($O_2$—32 amu) and carbon dioxide ($CO_2$—44 amu), respectively, as shown by traces 81, 49, 48, and 83, respectively. Temperature and the "on" time of the emitters 14, FIG. 1, are each graphically indicated herein by means of curves 85(*a*)-(*c*) and 87(*a*)-(*c*), respectively.

In this example, the probe head 17 is first held in the air (no matrix sample) and the emitters 14 are programmed to maintain a full power pulse 87(*a*), for 150 seconds. During that time, the trapped air volume temperature rises, as shown by curve 85(*a*). No resulting detection is made of any of the surface condition indicating compounds by the detector 28, FIG. 1, during this irradiation. Thus full power was maintained in this part of the example to the light energy emitters 14, FIG. 1.

In the second surface condition for a sod sample, the detector is similarly programmed to nominally maintain the light energy emitters 14, FIG. 1, using a full power pulse for 150 seconds. However, the detection of water by the detector 28, FIG. 1, as indicated by spike 89 in curve 81, after only a portion of the pulse time provides an indication that the surface temperature has risen sufficiently to liberate substantial water, this automatically causing the emitters 14, FIG. 1, to power down. Because the time cycle of 150 seconds is incomplete, a further power pulse 87(*b*) is generated upon the level of curve 81 falling below a threshold level, and a resulting spike 89 in water level again causes the emitters 14 to be powered down. A resulting saw tooth pattern is therefore developed for the irradiation of this surface. The resulting temperature curve 85(*b*) indicates a similar rise and fall pattern. During the irradiation of this surface, no perceivable changes are seen in the nitrogen level, plot 49.

Finally in the case of asphalt, a full power pulse is again applied by the emitters 14, FIG. 1, for 150 seconds, 87(*c*), heating the surface as shown by curve 85(*c*). In this instance, there is only a low increase in water level, evidenced by spike 95 to plot 48. This level is low because the surface of the asphalt stays comparatively cool due to higher thermal conductivity of asphalt, keeping this surface somewhat cooler as compared to the sod, and there are no organic materials that liberate water as they dry out before beginning to burn. As a result, the emitters 14, FIG. 1, are powered for the entire pulse, 87(*c*).

Figure 5:
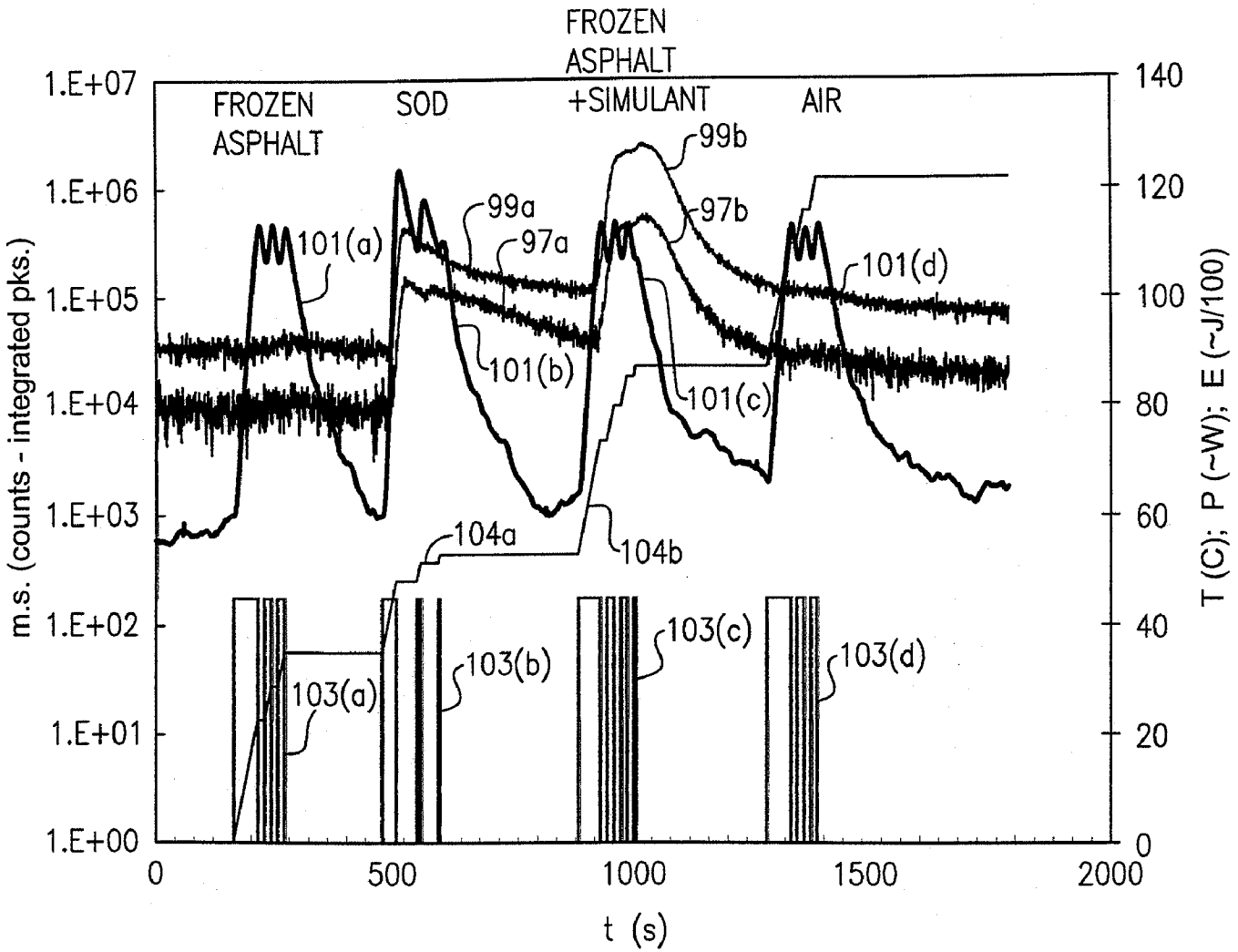
FIG. 5 is yet another sample display output from the detector of various irradiated surfaces, illustrating the feedback loop of the herein described probe assembly.

Referring to FIG. 5, there is shown another exemplary output of the herein described portable sampling probe assembly 10. In this example, time is also measured (in seconds) as well as temperature (in degrees Celsius) and mass spectrometer counts for various compounds to which the detector 28, FIG. 1, is tuned. In this example, select mass spectrometer scans are also indicated for a CWA simulant compound; namely, diethyphthalate (149 amu and 177 amu), as shown by plots 99 and 97, respectively, in connection with four (4) different surface types. In this example, only the air temperature—in the headspace region defined by the window, substrate, and skirt as measured by the sensor 32, FIG. 1, is used as a feedback means for controlling the light energy emitters 14, FIG. 1. Temperature curves for the four surfaces are represented as 101(*a*), 101(*b*), 101(*c*), and 101(*d*), respectively, while each of the "on/off" times of the light energy emitters 14, FIG. 1, are represented as 103(*a*), 103(*b*), 103(*c*), and 103(*d*). The surfaces used in connection with the portable light emitting probe assembly 10, FIG. 1, for purposes of this example are a frozen asphalt surface, a sod surface, a frozen asphalt surface that includes the simulant compound to be detected, and air. In each instance, the resulting temperature rise as detected by the sensor 32, FIG. 1, in the headspace 19, FIG. 1, controls the "on" time of the emitters 14, FIG. 1. In this example, temperature exceeding 115 degrees Celsius cause the detector to automatically shut down the emitters 14. A drop in temperature below this threshold turns the emitters back on. FIG. 5 shows power curves for sod 104(*a*) and heating frozen asphalt 104(*b*) demonstrating that more power is required to heat frozen asphalt than sod. Control of this power level reduces the level of mass spectrometer counts produced from intereferent compounds liberated while irradiating sod type materials 99(*a*), 97(*a*) relative to these same mass spectrometer peaks produced from the CWA simulant on frozen asphalt 99(*b*), 97(*b*).

The assembly of the preceding embodiment is intended to be portable or transportable. By "portable", it is intended that the entire assembly shown in FIGS. 1 and 2 can be carried by a single individual, the assembly being sufficiently lightweight (less than 40 pounds) to allow the assembly to be used in the field and be utilized for both indoor and outdoor applications to detect various compounds, including those that are listed below. By "transportable", it is intended that the probe assembly can be mounted to a vehicle, such as a truck. To that end, it should be apparent that numerous variations are possible.

Figure 6:
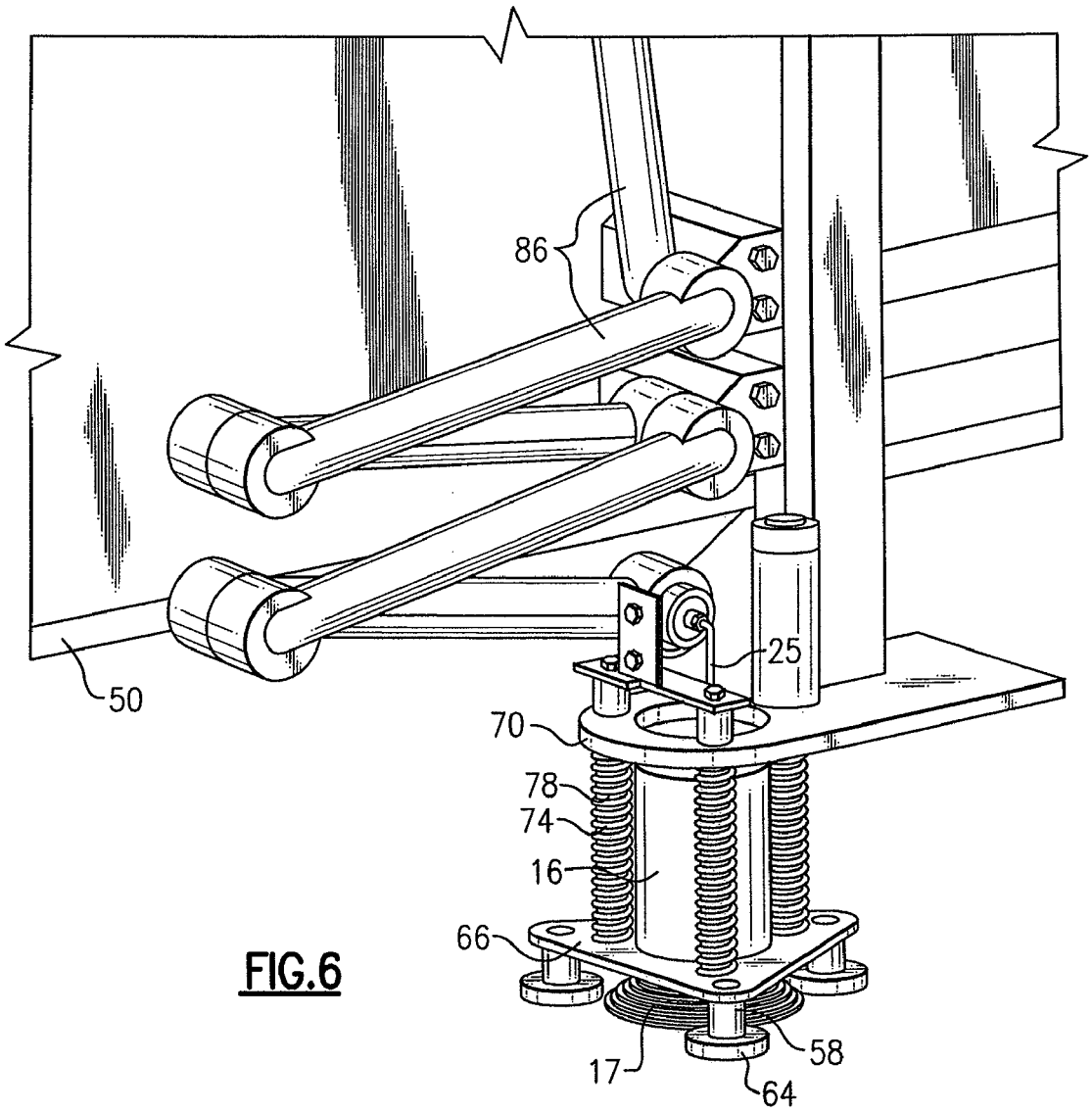
FIG. 6 depicts a light energy emitting sampling probe assembly made in accordance with a second embodiment.
Figure 7:
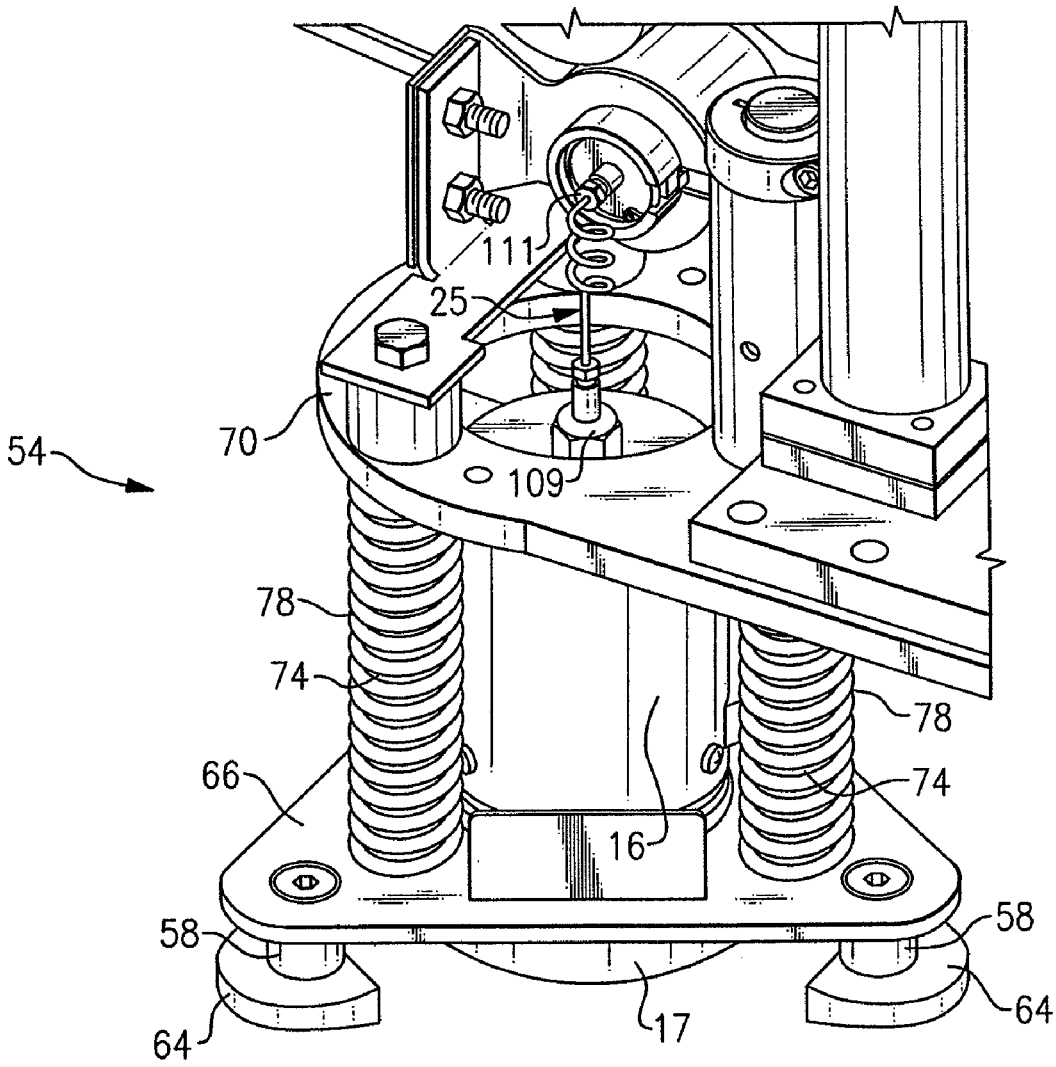
FIG. 7 is a perspective view of a portion of the leveling system used in the sampling probe assembly of FIG. 6.
Figure 8:
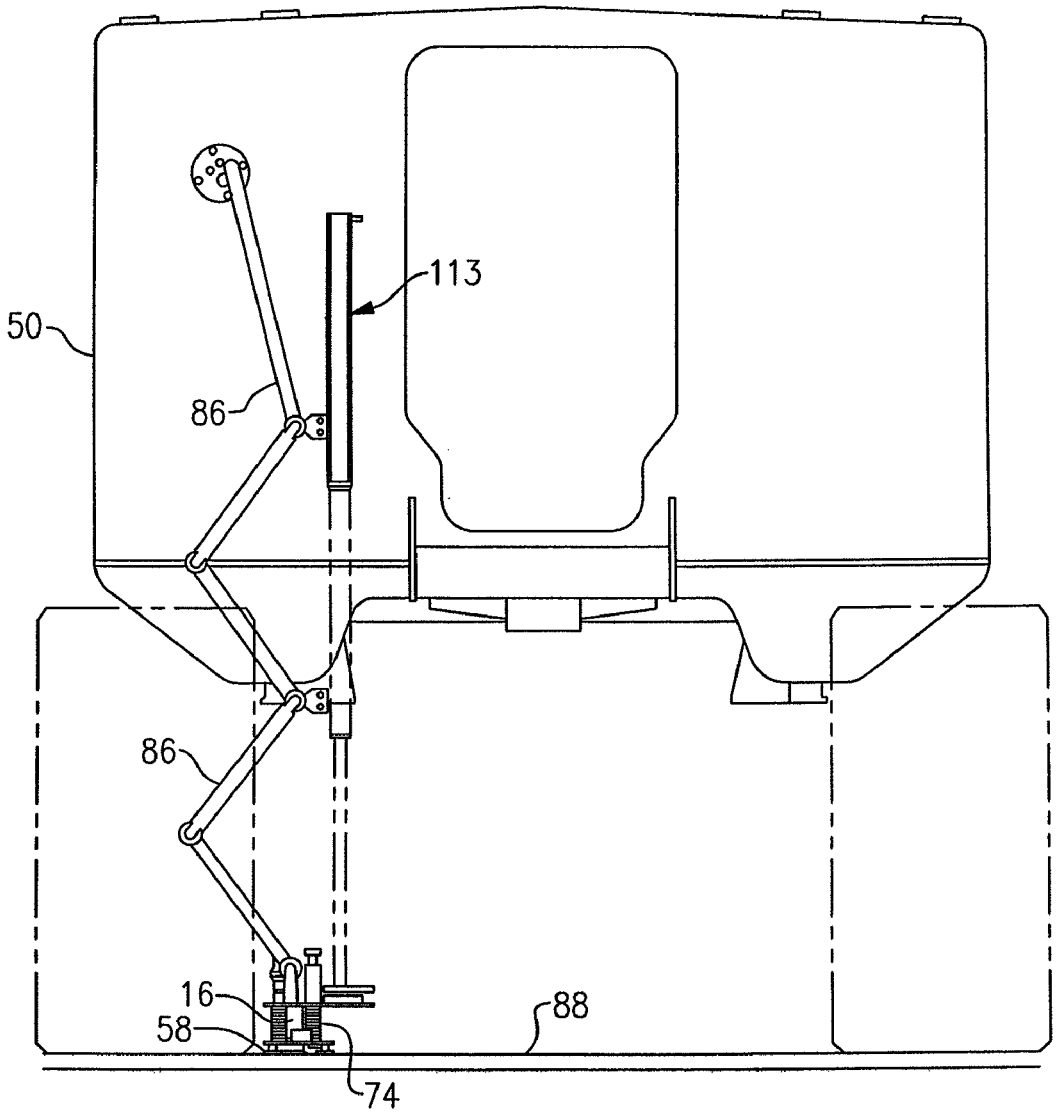
FIG. 8 is a side view of the vehicle and leveling system of FIGS. 6 and 7, having the sampling probe assembly attached thereto in relation to a ground surface.

With regard to the latter and referring by way of example to FIGS. 6-8, there is shown an apparatus for retaining a sampling probe assembly 10, this apparatus being used to support the sampling probe assembly in relation to a vehicle 50 such as, for example, a truck or a jeep.

The sampling probe assembly 10 used in this embodiment is similar to that previously described and therefore similar parts are herein labeled with the same reference numerals for the sake of clarity. That is, an assembly housing includes a probe head 17 that houses a series of light energy emitters (e.g., IR), as well as a collector tube or conduit that extends through a window provided at the distal end of the probe head. A temperature measuring sensor is also attached to an interior side wall of the probe head 17, wherein each of the sensor and the end of the collector tube extend through ports placed in the window. The window permits the heat energy portion of the emitted IR light to pass therethrough to the surface to the surface for irradiation thereof, while preventing combustion products or other materials from entering the probe head, except through the collector tube. The collector tube is attached via a capillary 25 extending from the top of the probe housing 16 via a threaded connection 109 to a port 111 that extends to a detector, the detector including a pump (not shown) that draws surface irradiated compounds in air carrier gas. The detector according to this embodiment is a portable gas chromatograph/mass spectrometer, which separates the sample compounds for identification.

Due to the need of the probe head 17 to be sufficiently proximate to a surface 88 of interest and also to insure that the probe is not damaged, the vehicle 50, shown only partially, is equipped with a leveling system 54 that according to this embodiment includes a set of three (3) legs 58, each surrounding the probe head 17. Each of the legs 58 includes a strut extending to a pad or foot 64 at an extending end thereof. Each leg 58 depends from and is fixedly secured to a lower plate 66. The probe housing 16 is also situated from the lower plate 66 and is disposed between each, wherein the lower plate and an upper plate 70 are separated from each other by a plurality of shafts 74. Each of the shafts 74 has a spring 78 situated about the exterior thereof, the shafts and springs being vertically disposed between the upper and lower plates 66, 70. The upper plate 70 is movable in relation to the lower plate 66 along the shafts 74, wherein the springs 78 can be compressed upon application of a downward (vertical) force supplied by an actuator unit 84, attached thereto, and allowing the probe assembly, and more particularly, the probe head 17 to be leveled in relation to the ground surface 88. The actuator unit 84 is powered from the vehicle 50 and includes a pair of extendable lift arms 86 operated from a rotating shaft that engage and move the supported probe assembly 10 vertically (e.g., up and down) in relation to the terrain or ground surface 88 along a vertical track defined by a lifting rail 113.

Otherwise and in use, the probe assembly 10 is used in a similar manner to that of the preceding in which the detector can be programmed to detect certain signature gases and to further utilize the temperature output of the sensor 32, FIG. 1, to control the power applied to the light energy emitters 14, FIG. 1.

The following is an exemplary, but not an exhaustive list of target compounds or materials, which are suitable for light energy desorption using the herein-described sampling probe apparatus:

A. Chemical Warfare Agents i). Nerve agents such as sarin, cyclosarin, soman, tauban, VX and Russian VX;

ii). Blistering agents such as sulfur mustard, nitrogen mustards and lewisite.

B. Explosive-Related Compounds i). Compounds such as TNT, RDX, HMX, Tetryl, PETN, nitroglycerine, triacetone triperoxide, hexamethylene triperoxide diamine, ammonium nitrate fuel oil; and ii). signature compounds such as dinitrotoluenes, mononitrobenzene, aminonitrotoluenes, nitroanilines, hexamine, detection taggants such as EGDN, DMNB, o-MNT, p-MNT.

C. Industrial Pollutants i). pesticides and herbicides; for example, methyl tert-butylester (MTBE), 2,4D, 2,4,5-TP (Silvex), acrylamide, alachlor, benzoapyrene, carbofuran, chlordane, dalapon, di 2-ethylhexyl adipate, di 2-ethylhexyl phthalate, dibromochloropropane, dinoseb, dioxin (2,3,7,8-TCDD), diquat, endothall, endrin, epichlorohydrin, ethylene dibromide, glyphosate, hepthachlor, hepthachlor epoxide, hexachlorobenzene, hexachlorocyclopentadiene, lindane, methoxychlor, oxamyl [vydate], PCBs [polychlorinated biphenlys], pentachlorophenol, picloram, simazine, and toxaphene.

ii). certain exemplary volatile industrial pollutants. Though the following pollutants are not typically termed as those rendering "low vapor pressure analyte"; these compounds would be suitable for detection from a surface by IR desorption in a frozen environment. Colder temperatures (such as temperatures below 0 degrees Celsius) make volatile compounds, such as the following, somewhat less volatile: Benzene, carbon tetrachloride chlorobenzene, o-dichlorobenzene, p dichlorobenzene, dichloromethane, 1,2-dichloroethane, 1,2-dichloropropane, ethylbenzene, styrene, tetrachloroethylene, 1,2,4-trichlorobenzene, 1,1,1-trichloroethane 1,1,2-trichloroethane, trichloroethylene, toluene, vinyl chloride, and xylenes. The viability of irradiating frozen surfaces to volatize these forms of agents is depicted in FIG. 5, as described above.

It will be readily apparent that there are other variations and modifications that will be readily apparent from the above description to those of standard skill in the field and that the following claims are intended to cover these variations and modifications.

The invention claimed is:

1. An apparatus for heating a surface to liberate at least one moderate or low vapor pressure analyte from said surface for detection thereof, said apparatus comprising:

a source of energy to irradiate said surface to cause heating thereof;

a collector to collect at least one gas volatilized from said surface, said at least one gas being capable of including said at least one liberated analyte;

a detector linked to said collector to detect the presence of said at least one liberated analyte, said detector including an ion source for ionizing said at least one collected gas collected from said surface; and means for controlling the power of said energy source based upon the detection of at least one surface condition indicator by said detector, said surface condition indicator being the detection of at least one signature gas acting as an indicator of the condition of said heated surface.

2. Apparatus as recited in claim 1, wherein said energy source utilizes light energy.

3. Apparatus as recited in claim 2, wherein said energy source emits infrared light.

4. Apparatus as recited in claim 1, wherein said detector comprises a mass spectrometer.

5. Apparatus as recited in claim 1, further comprising a temperature measuring device disposed in proximity to said surface and linked to a controller that is connected to said energy source.

6. Apparatus as recited in claim 3, including a port disposed in relation to said collector and said surface, said port having an opening through which a portion of said collector extends.

7. Apparatus as recited in claim 6, wherein said light source is retained within an enclosed portion partially defined by said port and said collector extends from said enclosed portion through the opening in said port.

8. Apparatus as recited in claim 1, wherein said detector is configured to detect at least one of $H_2O$ and $CO_2$ as surface condition indicators.

9. Apparatus as recited in claim 1, wherein said at least one signature gas is a surface combustion indicator.

10. Apparatus as recited in claim 1, wherein said at least one signature gas is a surface temperature indicator.

11. Apparatus as recited in claim 5, wherein the controller reduces the power of said energy source when a predetermined temperature is detected by said temperature measuring device.

12. Apparatus as recited in claim 7, wherein said port comprises a window made from a light transmissive material.

13. Apparatus as recited in claim 7, wherein said port comprises a grid structure having a substantially open area.

14. Apparatus as recited in claim 1, wherein the entirety of said apparatus is portable.

15. A method for protecting an apparatus used to detect the presence of at least one moderate or low vapor analyte liberated from a surface external to said apparatus, said method comprising the steps of:

irradiating said surface with a source of energy to heat said surface and to liberate said at least one analyte by volatilization thereof, if said at least one analyte is present;

collecting gas containing said at least one analyte caused by irradiating said external surface;

detecting the presence of said at least one analyte using a detector linked to said collector, wherein said detecting step include the additional steps of ionizing said collected gas prior to detection; and controlling the operation of said energy source by determining a condition of said surface through the detection of at least one signature gas acting as a surface condition indicator and adjusting the power of said energy source based on the detection of said surface condition indicator.

16. A method as recited in claim 15, including the step of measuring the temperature of the surface during said irradiation step and reducing the power of said energy source if a predetermined temperature is exceeded.

17. A method as recited in claim 15, wherein said at least one signature gas is at least one of $H_2O$ and $CO_2$.

18. A method as recited in claim 15, wherein said signature gas is indicative of a temperature increase of said surface.

19. A method as recited in claim 15, wherein said signature gas is indicative of combustion of said surface.

20. A method as recited in claim 15, wherein said signature gas is indicative of a surface condition that is capable of contaminating said collector.

21. A method as recited in claim 15, in which said signature gas is indicative that the surface has been sufficiently heated in order to liberate said at least one analyte.

* * * * *